United States Patent [19]

Wetherill

[11] Patent Number: 4,638,768

[45] Date of Patent: Jan. 27, 1987

[54] STEAM GENERATOR TUBESHEET/CHANNEL HEAD/CENTERSTAY ASSEMBLY

[75] Inventor: Todd M. Wetherill, Fawn Township, Allegheny County, Pa.

[73] Assignee: Westinghouse Electric Corp., Pittsburgh, Pa.

[21] Appl. No.: 720,206

[22] Filed: Apr. 4, 1985

[51] Int. Cl.[4] ..... F22B 17/02; F22B 37/10

[52] U.S. Cl. ..... 122/512; 122/32; 122/493

[58] Field of Search ..... 122/510, 512, 32, 33, 122/493; 165/72, 74

[56] References Cited

U.S. PATENT DOCUMENTS

| | | | |
|---|---|---|---|
| 663,464 | 12/1900 | Prince, Jr. . | |
| 1,404,561 | 1/1922 | Zwilling . | |
| 1,809,910 | 6/1931 | Price . | |
| 1,884,210 | 10/1932 | Potter | 122/512 |
| 2,107,604 | 2/1938 | Friday | 85/1.5 |
| 2,360,094 | 10/1944 | Arvins et al. | 257/233 |
| 3,147,743 | 9/1964 | Romanos | 122/32 |
| 3,213,833 | 10/1965 | Cunningham et al. | 122/34 |
| 3,254,709 | 6/1966 | Lyall | 165/158 |
| 3,286,696 | 11/1966 | Green et al. | 122/34 |
| 3,298,358 | 1/1967 | Alden, Jr. | 122/34 |
| 3,360,037 | 12/1967 | Ammon | 165/158 |
| 3,395,076 | 7/1968 | Ruppen, Jr. | 176/65 |
| 3,783,838 | 1/1974 | Michel | 122/34 |
| 3,841,272 | 10/1974 | Mayer et al. | 122/32 |
| 3,896,873 | 7/1975 | Wolowodiuk et al. | 165/76 |
| 3,900,010 | 8/1975 | Stiteler et al. | 122/32 |
| 3,906,905 | 9/1975 | Andrieu et al. | 122/32 |
| 4,190,101 | 2/1980 | Hartmann | 165/82 |
| 4,235,672 | 11/1980 | Harand et al. | 176/65 |
| 4,318,368 | 3/1982 | Carson et al. | 122/34 |
| 4,380,084 | 4/1983 | Aubert | 376/204 |
| 4,422,499 | 12/1983 | Batistoni | 165/71 |

FOREIGN PATENT DOCUMENTS 436299 4/1935 United Kingdom .

*Primary Examiner*—Edward G. Favors
*Attorney, Agent, or Firm*—L. A. DePaul

[57] ABSTRACT

A steam generator tubesheet/channel head/centerstay assembly wherein a threaded centerstay is screw-inserted to connect the tubesheet and the channel head. Seals are installed between the centerstay, the channel head and the tubesheet to prevent leakage.

10 Claims, 4 Drawing Figures

STEAM GENERATOR TUBESHEET/CHANNEL HEAD/CENTERSTAY ASSEMBLY

BACKGROUND OF THE INVENTION

This invention relates to a steam generator and, more particularly, to a threaded centerstay for connecting the tubesheet and channel head of the steam generator.

DESCRIPTION OF THE PRIOR ART

A typical nuclear steam generator generally comprises a first vertically oriented, outer shell and a second vertically oriented, inner shell which is known as the wrapper barrel. The wrapper barrel houses a plurality of U-shaped tubes forming a tube bundle. The area below the wrapper barrel includes: a tubesheet for supporting the tubes at the ends opposite the U-like curvature; a dividing plate cooperating with the tubesheet and forming a primary fluid inlet plenum at one end of the tube bundle and a primary fluid outlet plenum at the other end of the tube bundle; and a channel head. The tubesheet serves as a pressure boundary between the fluid circulating around the tube bundle in the wrapper barrel and the fluid in the channel head.

Under operational pressure, the tubesheet deflects. The magnitude of this deflection is governed by the tubesheet thickness and its connections to the outer shell. This deflection undesirably causes stresses in the tubesheet and the tubes connected to the tubesheet. To minimize the deflection, the tubesheet must be made extremely thick, which is, of course, costly both from a material standpoint and a manufacturing standpoint.

Recently, centerstays (also known as centerposts, although the term centerstay will be used synonymously herein for both) have been used in steam generators to help reduce the tubesheet thickness. For example, using a centerstay can reduce the tubesheet thickness from the traditional 28 inches to about 18–19 inches. In addition to reducing the required tubesheet thickness, the centerstay acts as a potential site for sludge collection and removal and provides improved tube bundle access.

More particularly, a centerstay is a hollow shaft located centrally through the tubesheet and the lower portion of the channel head. Generally, "through wall" or full penetration, pressure boundary welds are required to secure the centerstay to the tubesheet and channel head. Such a welded centerstay creates what is termed a "stayed tubesheet."

While the benefits of using a "stayed tubesheet" are significant, as discussed above, there are also several drawbacks. For example, manufacturing the tubesheet/channel head/centerstay assembly becomes difficult because of the close quarters within the channel head where welds must be made, and because of the great thickness which full penetration welds must extend (typically 5.0 inches). In addition, due to the welded nature of the installed centerstays, later removal, when desired, is very difficult. Finally, manufacturing and periodic inservice inspection requirements for centerstay welds are also of major concern. For example, the welds require inservice inspection in an area of high radioactivity in a nuclear steam generator, which, of course, raises worker safety considerations.

In light of the above discussions, maintaining the traditional benefits provided by a "stayed tubesheet," while facilitating centerstay manufacturing and inspection, is greatly desired.

SUMMARY OF THE INVENTION

Accordingly, it is an object of the present invention to provide a tubesheet/channel head/centerstay asesmbly which does not require welds.

It is another object of the present invention to provide a one-piece centerstay which can be easily installed and removed for inspection purposes or replacement.

Finally, it is an object of the present invention to provide a tubesheet/channel head/centerstay assembly, wherein the centerstay is threaded and can be easily screw-inserted to connect the tubesheet and the channel head.

To achieve the foregoing and other objects of the present invention and in accordance with the purposes of the invention, there is provided a solid, walled forged centerstay having a flange at one end and a threaded portion along part of the opposite end. The tubesheet also includes a threaded portion at the central internal surface thereof which corresponds to the threaded portion of the centerstay. During assembly, the threaded centerstay is inserted upwardly through a central hole in the bottom of the channel head until the centerstay threads are engaged with the corresponding threads formed in the tubesheet. Sealing means are employed at the interface of the flange and lower end of the channel head and at the interface of the end of the centerstay and the tubesheet to assure no leakage occurs. In addition, a bolted cap may be used at the flanged end of the centerstay or bolts can be installed in the flanged end of the centerstay and into the channel head, if desired.

The present invention has all the benefits of the conventional "stayed tubesheet," but makes implementation of the centerstay easier and less costly. More particularly, the threaded centerstay of the present invention facilitates installation, eliminates the conventional need for very thick and difficult welds in an area of minimum access, effects more simplified and cost-efficient production of the tubesheet/channel head/centerstay assembly, provides replacement capability, provides more efficient manufacturing and inservice inspection of the assembly, provides preload capability to the tubesheet and channel head and provides greater centerstay material selection.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

Figure 1:
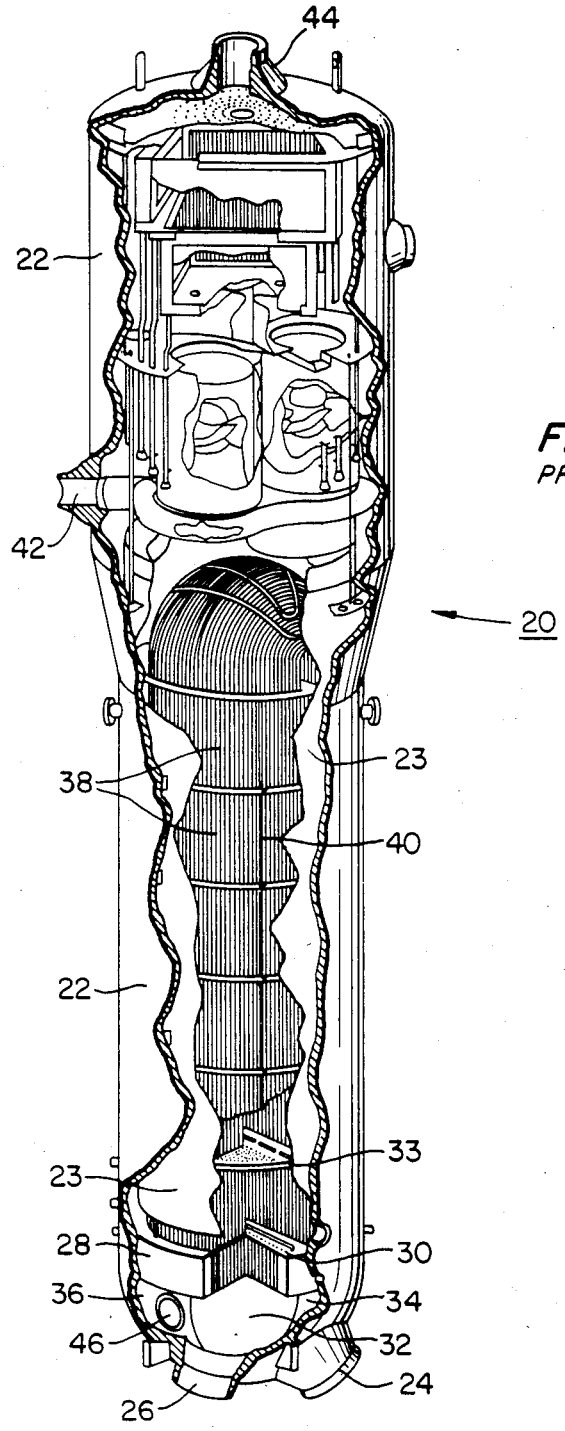
FIG. 1. PRIOR ART
FIG. 1 is an elevational, cut-away view of a conventional steam generator.

A vertical U-tube steam generator of the type generally referred to herein is more fully described in commonly owed U.S. Pat. No. 4,303,043, issued to MALICK. The present invention is described in reference to its being used in such a nuclear stem generator which is also shown in FIG. 1 herein. However, it is to be understood that the invention is not limited to use in the specific steam generator structure shown, As shown in FIG. 1, a nuclear steam generator is referred to generally by reference numeral 20, and comprises a vertical, outer shell 22 with a primary fluid inlet nozzle 24 and a primary fluid outlet nozzle 26 which is attached near the lower end. A vertical, inner shell 23, known as a wrapper barrel, has at its lower end a tubesheet 28, having tube holes 30 formed therein. Tubes 38, which are heat transfer tubes shaped with a U-like curvature, are disposed within the wrapper barrel 23 and are attached to a plurality of tube support plates 33 and the tubesheet 28 using the tube holes 30. The tubes 38, which may number about 7,000, form collectively what is known as tube bundle 40 through which as primary fluid, eminating from the reactor area, flows. A dividing plate 32, which is attached to both the tubesheet 28 and the channel head 29 (shown in FIG. 2), defines a primary fluid inlet plenum 34 and a primary fluid outlet plenum 36 in the lower end of the steam generator 20, as is well understood in the art. A channel head 29 (see FIG. 2) is located below the tubesheet 28. Further, a secondary fluid inlet nozzle 42 is disposed on the outer shell 22 for providing a secondary fluid, such as water, into the wrapper barrel 23, while a steam outlet nozzle 44 is attached to the top of the outer shell 22. Finally, manways 46 are provided through the channel head 29 to provide access to both the primary fluid inlet plenum 34 and the primary fluid outlet plenum 36, so that access may be had to the entire tubesheet 28.

In operation, the primary fluid enters the steam generator 20 through the primary fluid inlet nozzle 24 and flows into the primary fluid inlet plenum 34. The primary fluid then flows upwardly through the tubes 38 positioned in the tubesheet 28, around the U-shaped curvatures of the tubes 38, down through the tubes 38, into the primary fluid outlet plenum 36 and exits the steam generator 20 through the primary fluid outlet nozzle 26. While flowing through tubes 38, heat is transferred from the primary fluid to the secondary fluid which is introduced into the wrapper barrel 23 to surround the tubes 38, causing the secondary fluid to vaporize. The resulting steam then exits the steam generator through the steam outlet nozzle 44.

Figure 2:
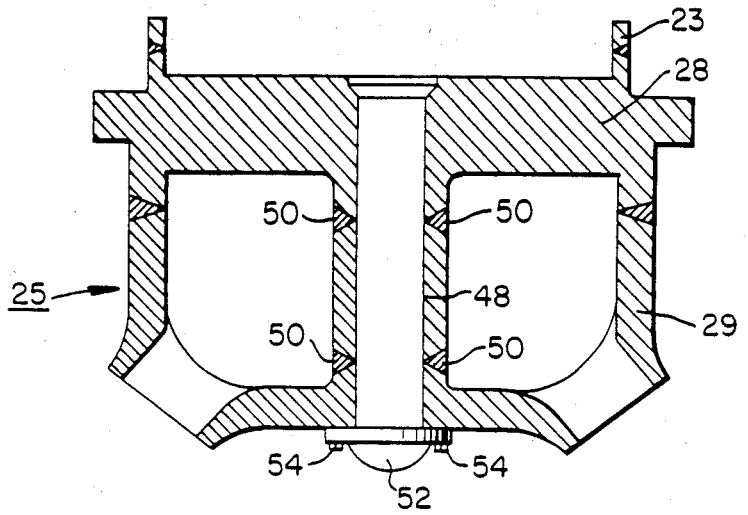
FIG. 2. PRIOR ART
FIG. 2 is a cross-sectional view of the lower part of the conventional steam generator shown in FIG. 1, illustrating particularly a conventional, welded, tubesheet/channel head/centerstay assembly.

FIG. 2 illustrates a conventional, welded, steam generator, tubesheet/channel heat/centerstay assembly 25. As suggested above, the tubesheet 28 serves as a pressure boundary between the secondary fluid circulating through the wrapper barrel 23 and the fluid circulating in the channel head 29 which is located beneath the tubesheet 28. In FIG. 2, the centerstay 48 is located centrally of the tubesheet 28 and the channel head 29 and is connected to the tubesheet 28 and the channel head 29 by through wall welds 50. The centerstay 48 may terminate in a cap 52 secured by bolts 54, as also known in the art.

As stated above, assembling the tubesheet/channel head/centerstay assembly 25 becomes difficult because of the close quarters within the channel head 28 where the welds 50 are made, and because of the great thickness which the full penetration welds 50 must extend. The welds 50 also require inservice inspection in an area of high radioactivity, which, of course, raises workers safety considerations.

Figure 3:
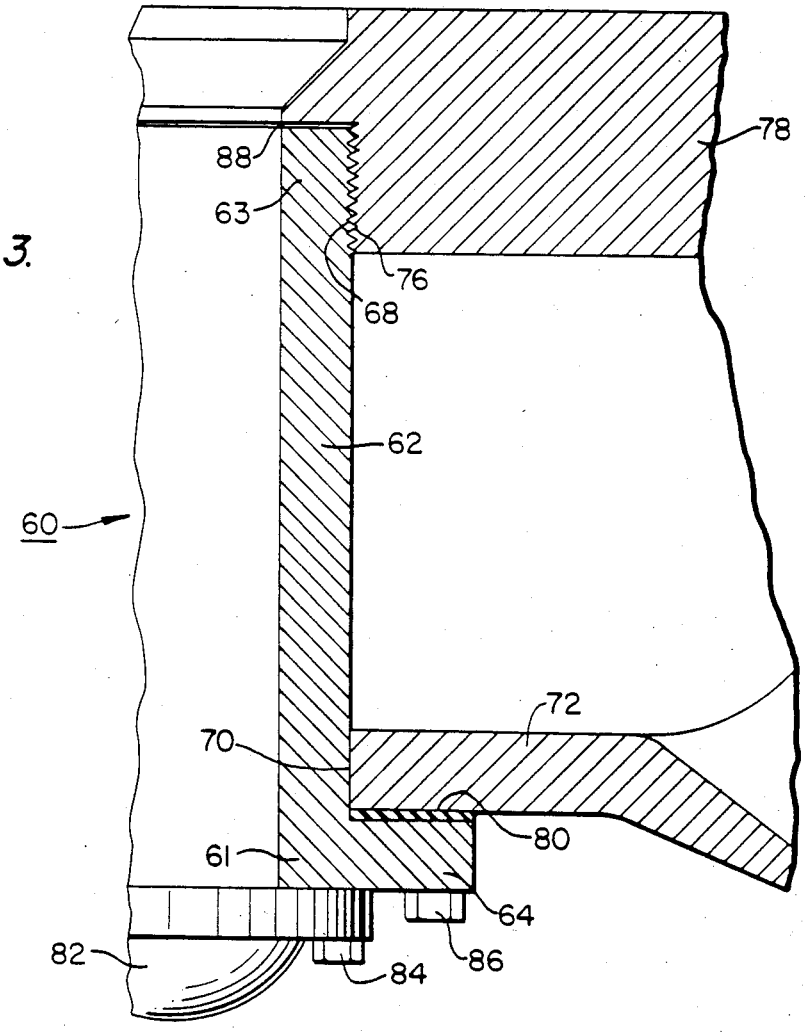
FIG. 3 is a cross-sectional view of the right, lower part of a steam generator, illustrating particularly the preferred embodiment of the tubesheet/channel head/centerstay assembly according to the present invention.

In contrast to the tubesheet/channel head/centerstay assembly 25 shown in FIG. 2, FIG. 3 illustrates the preferred embodiment of the tubesheet/channel head/-centerstay assembly 60 of the present invention including a "single-threaded" centerstay 62. Of course, as shown in FIG. 2, the left half of the assembly 60 is identical to the right half shown in FIG. 3.

More particularly, the preferred embodiment of the centerstay 62 of the present invention is solid walled, forged with a first end 61 and a second end 63. The first end 61 includes a flange 64 and the second end 63 includes a threaded portion 68 along the side surface thereof. The tubesheet 78 includes a threaded portion 76 along the internal surface thereof which corresponds to the threaded portion 68 of the centerstay 62.

During assembly, the centerstay 62 is inserted upwardly through a central opening 70 formed in the bottom of the channel head 72 until the threaded portion 68 engages the corresponding threaded portion 76 of the tubesheet 78. The centerstay 62 is screwed into the tubesheet 78 to a predetermined level.

If desired, an actual prelaod can be achieved by heating the centerstay 62 and advancing it in the same manner in which a large heated stud would be preloaded.

As the centerstay 62 is tightened, a sealing means 80, e.g., a metal gasket, is engaged at the interface of the flange 64 and the lower end of the channel head 72 to seal this connection. In addition, at the interface of the second end 63 of the centerstay 62 and the tubesheet 78, another sealing means 88, for example, a welded, flexible seal like an Omega seal, may be used to assure that no leakage occurs at this connection. A cap 82 and bolts 84 may be inserted after the centerstay 62 is in place. Finally, bolts 86 may be inserted through the flange 64 and into the channel head 72 to complete the assembly 60.

As seen, the threaded centerstay of the present invention eliminates the through wall welds traditionally used in the area of the centerstay. This, of course, simplifies construction and inservice inspection requirements.

Figure 4:
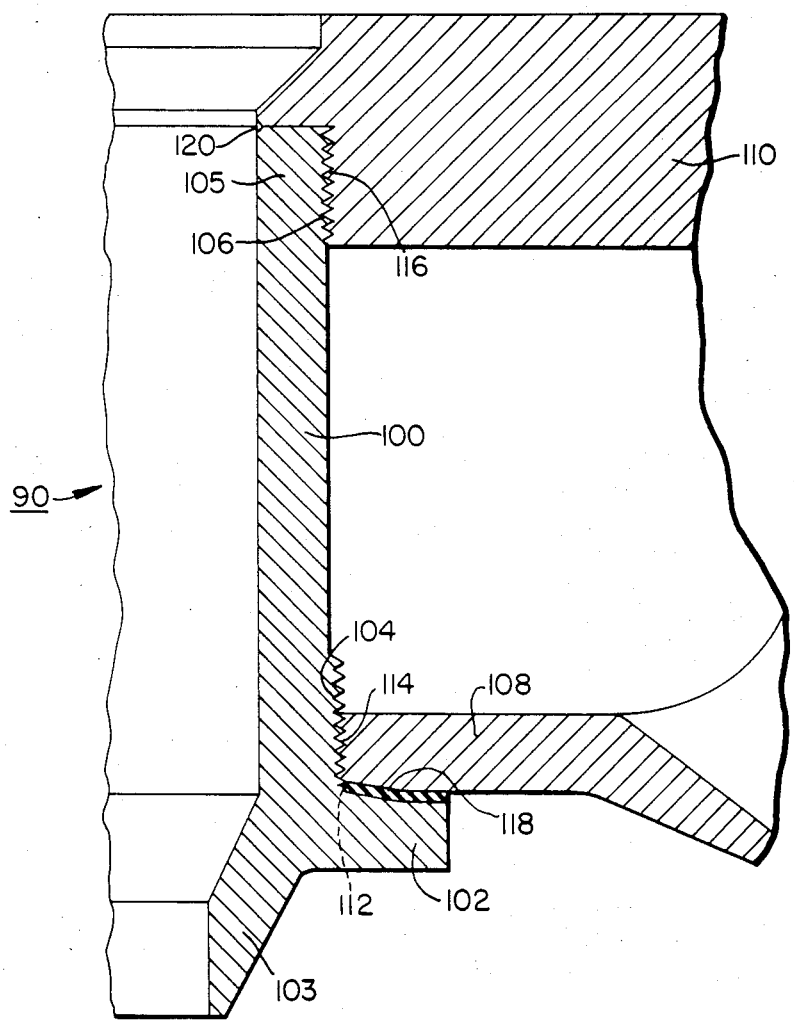
FIG. 4 is a cross-sectional view of the right, lower part of a steam generator, illustrating particularly an alternate embodiment of the tubesheet/chanenl head/centerstay assembly of the present invention.

FIG. 4 illustrates another embodiment of the present invention, i.e., a tubesheet/channel head/centerstay assembly 90 including a "double-threaded" centerstay 100. Of course, as shown in FIG. 2, the left half of the assembly 90 is identical to the right half shown in FIG. 4.

In this embodiment, the centerstay 100 shown in FIG. 4 is similar to the preferred embodiment of the centerstay 62 shown in FIG. 3 in that it is solid walled, forged, has a flange 102 at a first end 103 and a threaded portion 106 at a second end 105 and a threaded portion 116 formed on the inner surface of the tubesheet 110. However, the alternate embodiment centerstay 100 also includes a threaded portion 104 near the first end 103 and the channel head 108 includes a corresponding threaded portion 114.

Of course, when the "double-threaded," alternate embodiment is practiced, the threaded portions of the centerstay 100, the tubesheet 110 and the channel head 108 must be machined such that the uppermost threads of each of the threaded portions 104 and 106 thereof simultaneously engage the lowermost threads of each threaded portion 114 and 116, respectively.

During assembly, the centerstay 100 of the embodiment shown in FIG. 4 is screw-inserted through a central opening 112 in the bottom of the channel head 108 as the threads 104 engage the corresponding threads 114 formed in the channel head 108. The threaded portion 106 then engages the threaded portion 116 of the tubesheet 110. The centerstay 100 is screwed into the tubesheet 110 to a predetermined level.

If desired, an actual preload can again be achieved by heating the centerstay 100 at its midsection, and advancing it in the same manner in which a large heated stud would be preloaded.

As the centerstay 100 is tightened, a sealing means 118, e.g., a valve seat type seal, may be engaged between the flange 102 and the channel head 108, for sealing this interface. In addition, another sealing means 120, for example, a simple seal weld, is used between the second end 105 of the centerstay 100 and the tubesheet 110 to maintain a seal at this interface. The weld 120 can be easily cut in the centerstay 100 needs to be removed.

The present invention also contemplates that the preferred embodiment centerstay 62 shown in FIG. 3 can include a separate threaded portion at the flanged end thereof. As such, both the tubesheet 78 and the channel head 72 would include corresponding threaded portions along the internal surfaces thereof to form a "double-threaded" assembly comparable with the embodiment shown in FIG. 4. On the other hand, the alternate embodiment centerstay 100 shown in FIG. 4 may include only a signal threaded portion at the second end 105 thereof comparable with the preferred embodiment centerstay 62 shown in FIG. 3.

An important concern related to the present invention might be whether the threaded centerstay is able to withstand the pressure loads imposed during the most severe operating conditions of a steam generator. However, some preliminary calculations have been performed which indicate that these loads can indeed be accommodated by the present invention. Based on primary hydrotest finite element stress results, a net axial load of approximately $14.5\times10^6$ lbf can be carried by the centerstay of the present invention. As a check on design feasibility, a major thread diameter of 30.0 inches was assumed. A thread based on the Unified Fine Thread Series proportions was selected, having 4.0 threads per inch. With these parameters, it was found that approximately 12.0 inches of thread engagement was necessary to maintain shear stress levels less than $0.6S_m$, in accordance with the American Society of Mechanical Engineers Code. Considering the traditional 18–19 inch tubesheet, there appears to be ample thickness to provide the necessary thread engagement.

Another important concern of the design of the the present invention might be in the sealing maintenance of the centerstay to tubesheet interface and in the centertay to channel head interface. However, as discussed above, a seal can be used at the interface of the tubesheet and the centerstay. At the lower end, sealing may also be satisfactorily accomplished between the channel head and the centerstay, as discussed above.

Overall, the threaded centerstay of the present invention provides significant benefits over the traditional welded centerstay design. More particularly, the centerstay of the present invention simplifies the manufacturing/assembly of the tubesheet/channel head/centerstay/assembly. This invention also eliminates the very thick and difficult welds in an area of minimum access. The one-piece forged centerstay is both simpler to fabricate and is more reliable than a welded centerstay. The manufacturing of the centerstay of this invention, and the threads cut in the tubesheet and channel head are well within current manufacturing capabilities. Furhter, manufacturing and periodic inservice non-destructive examinations are simplified by the use of a threaded centerstay. In addition, the threaded centerstay has replacement capability should the need arise. The threaded centerstay of the present invention also has the potential for actually providing a preload to the tubesheet and channel head, thus reducing the required tubesheet thickness even further. Finally, centerstay material selection could be expanded, for example, 410 stainless steel might be used to avoid cladding.

The foregoing is considered as illustrative only of the principles of the invention. Further, since numerous modifications and changes will readily occur to those skilled in the art, it is not desired to limit the invention to the exact construction and operation shown and described and, accordingly, all suitable modifications and equivalents may be resorted to, falling within the scope of the invention and the appended claims and their equivalents.

I claim as my invention:

1. A tubesheet/channel head/centerstay assembly for a steam generator, comprising:

(a) a tubesheet having a threaded internal portion formed therein;

(b) a channel head located adjacent the tubesheet having an opening formed therein; and (c) a hollow centerstay having an external threaded portion formed therein corresponding to the threaded portion of the tubesheet, wherein the threaded centerstay is screw-inserted to join the channel head and the tubesheet and to reinforce the tubesheet under pressure against the channel head.

2. The assembly as recited in claim 1, wherein the centerstay further comprises:

(i) a first end and a second end, (ii) an external portion of the first end having a flange formed thereon, and (iii) an external portion of the second end having the threaded portion formed therein.

3. The assembly as recited in claim 2, further comprising:

sealing means located between the centerstay, the channel head and the tubesheet.

4. The assembly as recited in claim 3, wherein the centerstay is heated to create a preload as it is being screw-inserted.

5. A tubesheet/channel head/centerstay assembly for a steam generator, comprising:

(a) a tubesheet having a threaded internal portion formed therein;

(b) a channel head located adjacent the tubesheet having an opening formed therein;

(c) a centerstay having (i) a first end and a second end, (ii) an external portion of the first end having a flange formed thereon, and (iii) an external portion of the second end having a threaded portion formed therein, wherein the threaded centerstay is screw-inserted to join the channel head and the tubesheet; and (d) sealing means located between the centerstay, the channel head and the tubesheet, wherein the sealing means includes (i) a seal weld between the tubesheet and the centerstay, and (ii) a valve seat type seal between the channel head and the centerstay.

6. A tubesheet/channel head/centerstay assembly for a steam generator, comprising:

(a) a tubesheet having a threaded internal portion formed therein;

(b) a channel head located adjacent the tubesheet having an opening formed therein;

(c) a centerstay having (i) a first end and a second end, (ii) an external portion of the first end having a flange formed thereon, and (iii) an external portion of the second end having a threaded portion formed therein, wherein the threaded centerstay is screw-inserted to join the channel head and the tubesheet; and (d) sealing means located between the centerstay, the channel head and the tubesheet, wherein the sealing means includes (i) an Omega seal between the tubesheet and the centerstay, and (ii) a metal gasket between the channel head and the centerstay.

7. The assembly as recited in claim 6, further comprising:

a plurality of bolts extending through the flange and into the channel head.

8. The assembly as recited in claim 7, further comprising:

a bolted cap covering the first end of the centerstay.

9. The assembly as recited in claim 8, wherein the centerstay further comprises a second, external threaded portion formed therein and the channel head further comprises a threaded portion formed therein corresponding to the second, external threaded portion of the centerstay.

10. A tubesheet/channel head/centerstay assembly for a steam generator, comprising:

(a) a tubesheet having a threaded internal portion formed therein;

(b) a channel head located adjacent the tubesheet having an opening formed therein; and (c) a centerstay having (i) a first, external threaded portion formed therein corresponding to the threaded portion of the tubesheet, and (ii) a second, external threaded portion formed therein, wherein the channel head further includes a threaded portion formed therein corresponding to the second, external threaded portion of the centerstay, and wherein the threaded centerstay is screw-inserted to join the channel head and the tubesheet.

* * * * *